United States Patent [19]

Voges

[11] 4,419,957

[45] Dec. 13, 1983

[54] ADHESIVE COATING APPARATUS FOR COATING SHEET-LIKE MATERIALS

[75] Inventor: Wolfgang Voges, Erlangen, Fed. Rep. of Germany

[73] Assignee: Claus Koenig KG, Erlangen, Fed. Rep. of Germany

[21] Appl. No.: 206,290

[22] Filed: Nov. 12, 1980

[30] Foreign Application Priority Data

Jul. 21, 1980 [DE] Fed. Rep. of Germany ..... 3027564

[51] Int. Cl.[3] ..... B05C 1/02

[52] U.S. Cl. ..... 118/245; 118/261

[58] Field of Search ..... 118/245, 262, 249, 261

[56] References Cited

U.S. PATENT DOCUMENTS 1,756,833 4/1930 Price ..... 118/245
2,702,254 2/1955 Dowd ..... 118/246 X
3,154,434 10/1964 Rosenthal ..... 118/245
3,752,114 8/1973 Knight ..... 118/245 X

*Primary Examiner*—John P. McIntosh
*Attorney, Agent, or Firm*—Schuyler, Banner, Birch, McKie and Beckett

[57] ABSTRACT

An adhesive coating apparatus for coating sheet-like materials incorporates an adhesive trough and a roll system for coating the materials wherein the adhesive trough and roll system are arranged in a housing provided with an opening for the materials to be coated, this opening being provided in a horizontal cover plate of the housing which can be closed off by a flat cover resting on the housing cover plate. Strippers are disposed vertically above the adhesive trough with the adhesive trough as well as the roll system being fixedly attached relative to the cover plate.

7 Claims, 5 Drawing Figures

ADHESIVE COATING APPARATUS FOR COATING SHEET-LIKE MATERIALS

BACKGROUND OF THE INVENTION

The invention relates to an adhesive coating apparatus for coating sheet-like materials by means of an adhesive trough and a roll system for coating and drawing in the material in question, wherein the adhesive trough and roll system are arranged in a housing provided with an inlet/outlet opening for the material to be coated which corresponds to the maximum width of the material, the material being fed to said opening with the aid of strippers cooperating with a coating roll of the roll system.

This type of apparatus as known in the art, has the opening provided in a vertical wall of the housing, from which both the coating roll and a feed roll project laterally. Moreover, strippers are provided which face the opening laterally and are urged resiliently against the surface of the coating roll to ensure that the coated material is thrown off the coating roll following coating. The adhesive trough is fitted in the lower section of the housing as a component thereof.

In this type of adhesive coating device, care should be taken that it is sealed shut when not in use, because normally the adhesive contains a solvent which evaporates easily and thus can create an offensive odor problem. Moreover, evaporation can cause the adhesive to thicken unduly. Therefore, the desire exists to provide such devices with simply designed sealing surfaces in order to be able to effect the necessary sealing in an easy manner.

In the apparatus described above, a cover is urged against the opening provided in the vertical wall of the housing by means of a toggle-joint arrangement which, for purposes of sealing, must continually be pressed against the opening. In addition, care must be taken in this prior apparatus that the adhesive does not get to the sealing surfaces between the cover and vertical wall when it is flowing down the strippers, because this would damage the sealing materials.

SUMMARY OF THE INVENTION

It is an object of the invention to simplify the sealing closure of this type of apparatus when not in use, designing it in such fashion that during operation the adhesive virtually cannot escape from the opening. This problem is solved according to the invention in that the opening in a horizontal cover plate of the housing can be closed by a flat cover resting on the cover plate, the inlet/outlet opening and the roll-type coating means together with the strippers being disposed vertically above the adhesive trough, and the adhesive trough being sealing attached to the housing.

By providing the opening in the horizontal cover plate of the housing, the cover can close the opening due to the pull of gravity alone. Furthermore, it goes without saying that it can be urged against the horizontal cover plate by any kind of tensioning elements. Also, there is the advantage that adhesive which flows down any component parts of the roll system or down the strippers must automatically return to the adhesive trough, since all these parts lie vertically above the adhesive trough, that is to say they do not project laterally therebeyond. This arrangement of the component parts, which are appropriate for the adhesive coating, above the adhesive trough with the opening there-above causes vapors of the adhesive solvent to be held substantially within the cavity below the horizontal cover plate of the housing and below the opening, since these vapors are heavier than air. The construction of the apparatus ensures automatically that these vapors are to a certain extent held captive by the apparatus, even when the latter is opened during operation.

The arrangement of the coating roll vertically above the adhesive trough permits the use of the coating roll itself as an immersion roll which dips into the adhesive and during rotation entrains an adhesive film through transfer to the material in question.

Advantageously, the apparatus is driven directly by means of the coating roll, for which purpose the shaft of the coating roll passes sealingly and with allowance for rotation through a front wall of the adhesive trough and terminates in a hand crank situated outside the housing. In this case, it is advantageous to simultaneously drive a feed roll which is associated with the roll system by passing the shaft of the feed roll sealingly and with allowance for rotation through the same front wall and positively connecting it externally of the adhesive trough to the shaft of the coating roll.

The arrangement of the coating roll directly below the opening permits the strippers to be fastened such as to make them easily accessible for repair. Appropriately, the strippers consist of a plurality of adjacent spaced-apart wire springs which are resiliently urged with one end against the surface of the coating roll on its side facing the opening, run from the coating roll in a direction pointing to the opening, and each fastened at its other end externally on the cover plate within the cover. The wire spring strippers can easily break off when the apparatus is not properly handled. With this construction they can easily be replaced because their ends, which are fastened to the cover plate, can easily be reached for repair. To replace a wire spring, all that needs to be done is to take off the cover and loosen the fastener for the wire springs e.g., a screw.

A horizontal shaft serving as a doctor element can likewise be fitted advantageously in the adhesive trough, mouting it such that it can slide in the direction of the coating roll. Adhesive that drips down the doctor returns automatically to the adhesive trough. This doctor element positioning arrangement permits easy sliding and, thus, easy adjustment of the thickness of the adhesive coating. To this end, both ends of the doctor shaft are mounted in rectangular slots with allowance for sliding, the ends being urged by spring tension against bevelled guides which are adjustably mounted by means of set screws extending through the cover plate. The mechanism itself for sliding the doctor shaft also lies in the adhesive trough and only the two set screws pass through the cover plate which can easily be sealed at this location.

BRIEF DESCRIPTION OF THE DRAWINGS

A preferred embodiment of the invention is shown in the drawings, wherein.

DESCRIPTION OF THE PREFERRED EMBODIMENT

Figure 1:
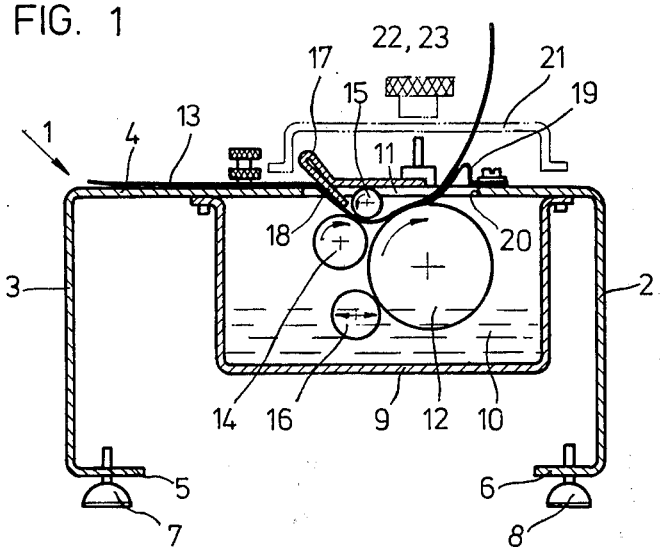
FIG. 1 is a cross-sectional view of the apparatus.

FIG. 1 is a cross-sectional view of the adhesive coating apparatus embodying the invention. It consists of a housing 1 which is made up of vertical walls 2 and 3 and horizontal cover plate 4 connecting the same. Vertical walls 2 and 3 change into squared-off portions 5 and 6 into which are screwed feet 7 and 8. Adhesive trough 9 is screwed into the underside of cover plate 4, which results in a sealing connection between adhesive trough 9 and cover plate 4. Adhesive trough 9 is filled, as required, with adhesive 10 which comes from a supply not shown herein. Above adhesive trough 9 an opening 11 is provided in cover plate 4.

In adhesive trough 9 a roll system is placed which consists of a coating roll 12 which dips into the adhesive 10 and which entrains on its surface an adhesive film while rotating in accordance with the arrow shown in the drawing. Sheet-like material 13, e.g., a plastic film or a sheet of paper, is fed to coating roll 12. This feed is effected by means of feed roll 14, against which is urged backing roll 15, so that sheet-like material 13 is guided securely by rolls 14 and 15. The common tangent of rolls 14 and 15 meets on coating roll 12 at an angle greater than 90°, so that sheet-like material 13, while being fed by coating roll 12, is deflected upwards. Rotation of coating roll 12 causes feed roll 14 to be driven simultaneously. This will be described in detail below with reference to FIG. 4. The horizontal shaft 16 which serves as a doctor element and is spaced the proper distance from coating roll 12 is placed in adhesive trough 9 so that an adhesive film defined by said distance can develop on coating roll 12. The distance from doctor shaft 16 to coating roll 12 is adjustable. This will be detailed below with reference to FIG. 5.

As apparent from the drawing, the sheet-like material 13 fed across the surface of cover plate 4 is guided through opening 11, for which purpose there is provided a feed plate 17 fastened to cover plate 4. Feed plate 17 protrudes obliquely upwards from the surface of cover plate 4 and projects with its leg 18 likewise obliquely inwards through opening 11, so that a newly fed sheet of sheet-like material 13 is automatically guided between rolls 14 and 15, and is gripped thereby. Sheet-like material 13 meets rotating coating roll 12 at such an angle that its front end, as shown, is deflected upwards in the direction of opening 11. The front end of sheet-like material 13 is thereupon lifted from the surface of coating roll 12 by strippers 19, which are formed as wire springs, and directed out of the apparatus through opening 11. Thus, there is a sequence of motions of sheet-like material 13, during which it is introduced into the apparatus from the surface of horizontal cover plate 4 through opening 11 and, after coating, guided out through opening 11 by coating roll 12. The coating of sheet-like material 13 occurs in a manner in itself known through transfer of the adhesive film entrained by coating roll 12 to the side of the sheet-like material 13 which is turned toward coating roll 12.

Now, when during the coating procedure a liquid adhesive 10 drips from any component part, e.g., from doctor 16 or strippers 19, the dripping adhesive automatically returns to adhesive trough 9 due to the pull of gravity. Thus, it cannot escape laterally to soil the apparatus in an undesirable manner. Strippers 19, which are formed as wire springs, project from edge 20 of opening 11 to such an extent that the adhesive which drips therefrom and which may come from coated sheet-like material 13 automatically drips back into adhesive trough 9.

The arrangement of adhesive trough 9 clearly shows that the evaporating solvent of adhesive 10, due to its higher weight in relation to air gathers, in the free space of adhesive trough 9, above adhesive 10 and only a small amount is whirled out of adhesive trough 9 so that even when the apparatus is in operation the stench problem is reduced to a minimum.

Figure 2:
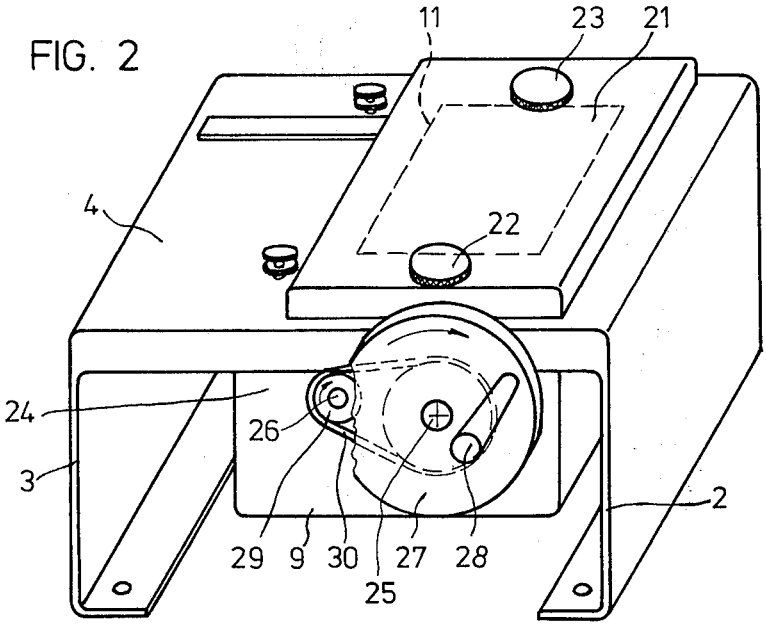
FIG. 2 is a perspective view of the apparatus with the cover in place.

FIG. 1 shows in dashed line the cover 21 which can be put on flat cover plate 4 and can be urged thereagainst by means of screws 22, 23 (FIG. 2). It goes without saying that in order to put the apparatus into operation one must remove cover 21. Since the cover must only shut off opening 11 in cover plate 4, from which only feed plate 17 projects slightly and above which strippers 19 rise up, cover 21 can be constructed with comparatively small overall height, resulting in simpler construction.

FIG. 2 shows in perspective view the apparatus illustrated in FIG. 1 in cross-sectional view, but with the cover 21, which is fastened to the surface of cover 4 by means of screws 22 and 23, put on. The drawing also shows the front wall 24 of adhesive trough 9, from which protrude shaft 25 of coating roll 12 and shaft 26 of feed roll 14. There is mounted on shaft 25 the crank disk 27 into which enters turning handle 28 so that a crank mechanism drive results. Front wall 24 is traversed by shaft 26 of feed roll 14 on which is secured belt pulley 29. There is laid over belt pulley 29 a transmission belt 30 which also embraces the belt pulley 31 secured on shaft 25 (FIG. 4), so that there is a positive connection between shafts 25 and 26. Thus, upon rotation of the crank mechanism drive made up of turning handle 28 and crank disc 27 which causes coating roll 12 to be driven, feed roll 14 is automatically driven also.

In FIG. 2 the rim of opening 11 is shown in dashed line below cover 21. Hence it follows that from the mechanical design point of view opening 11 can very easily be covered by cover 21, due to its position in cover plate 4.

Figure 3:
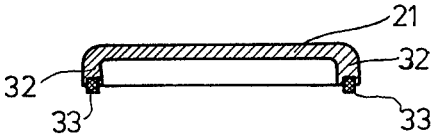
FIG. 3 is a cross-sectional view of the cover.

FIG. 3 is a cross-sectional view of cover 21 alone. It goes without saying that on the end faces thereof not shown herein it has the same side walls as those labeled 32 in FIG. 3. In these side walls 32, which extend around the entire cover 21, a sealing strip 33 is inserted as to ensure proper sealing against the surface of cover plate 4.

FIG. 4 again shows the apparatus of FIGS. 1 and 2 in perspective view, but without the cover 21 shown in FIG. 2. To give a better view of the crank mechanism drive consisting of turning handle 28, crank disc 27, and belt pulley 31, the crank disk 27 and the cover plate 4 are shown with parts broken away. On the surface of cover plate 4 are shown the set screws 34 for strippers 19, from which it follows that merely by loosening a screw 34 can the stripper 19 in question be removed and, if necessary, replaced by another.

Figure 4:
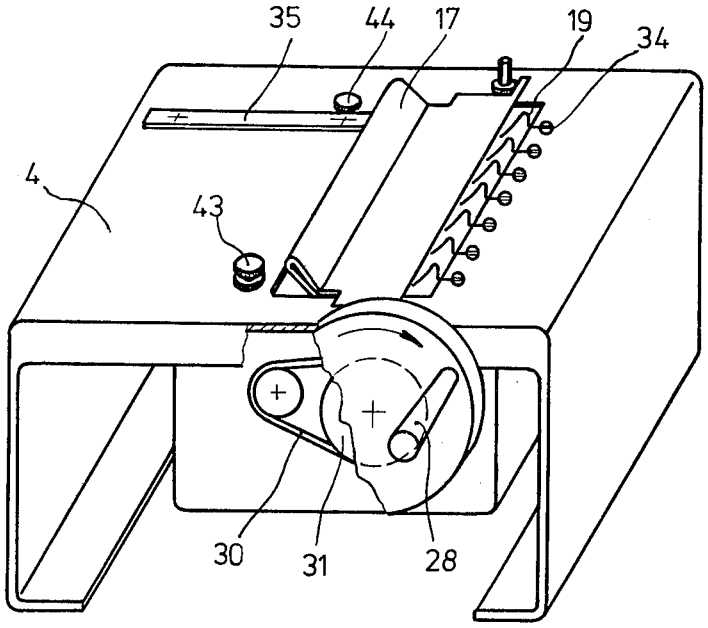
FIG. 4 is a perspective view of the apparatus without the cover.

FIG. 4 shows a guide stop 35 which is secured to the surface of cover plate 4. Its function is to give good lateral guidance to the sheet-like material being fed into the apparatus.

Figure 5:
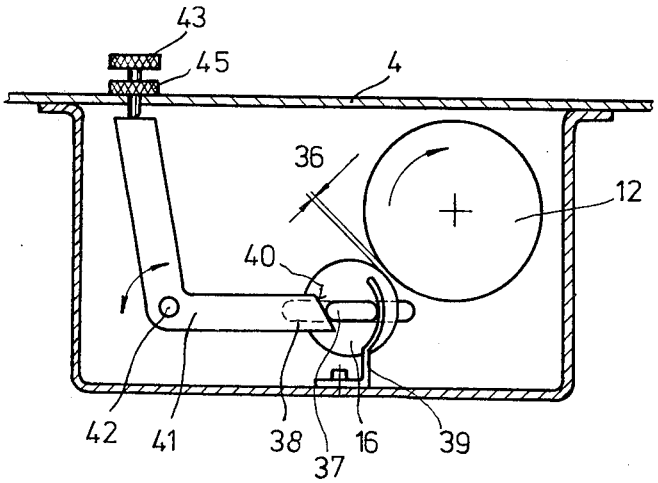
FIG. 5 is a side view of the parts effecting the adjustment of the doctor shaft.

FIG. 5 shows how doctor shaft 16 can be reciprocated in relation to coating roll 12. The position of doctor shaft 16 is shown in FIG. 5 in such a way that it is spaced a distance 36 from the surface of coating roll 12. Doctor shaft 16 terminates at both ends in flat stubs 37, each of which is mounted in a rectangular slot 38 provided in adhesive trough 9, so that they can slide in rectangular slot 38 without allowing doctor shaft 16 to rotate. Stubs 37 are urged away from coating roll 12 by spring clip 39, but they abut against bevelled guides 40, which are component parts of toggle lever 41. The toggle lever is pivotally mounted on spindle 42 and extends to a point immediately below the inner surface of cover plate 4, where it is engaged by set screw 42. The set screw 44 shown in FIG. 4 is provided for the other side of doctor shaft 16. Set screw 43 (and, of course, set screw 44 also) can be fixed by locking nut 45. Set screws 43 and 44 pass through cover plate 4 in such a way that no sealing problems can arise at their location. Turning the set screw 43 or 44 will cause the toggle lever 41 to swing, so that stubs 37 of the doctor shaft are shifted laterally via bevelled guides 40. In this way, spacing 36 between doctor shaft 16 and coating roll 12 can be adjusted as required.

Having described a preferred embodiment of the invention, it should be apparent to those skilled in the art that a number of variations can be employed within the scope of the invention. Accordingly, it should be realized that the scope of the invention is not to be considered as limited by such description but is to be governed only by the scope of the herein appended claims.

I claim:

1. An apparatus for coating sheet-like material with adhesive comprising:

a housing having a generally horizontal cover plate and a material inlet/outlet opening in said cover plate through which sheet material enters said housing uncoated and exits said housing after being coated with adhesive;

an adhesive trough disposed within and sealingly connected to said housing, said trough being located below said cover plate and under said opening; and coating means disposed within said housing located substantially completely below said cover plate and over said trough, for drawing sheet material along said cover plate and downwardly into said housing through said opening, drawing adhesive from said trough and applying it to said sheet material, and expelling coated sheet material from said housing upwardly through said opening, wherein adhesive dripping from said coating means will fall away from said opening into said trough, and said opening can be sealed when said coating apparatus is not in use by a substantially flat cover which extends over said opening and sealingly engages said cover plate to prevent the escape of vapors from said housing.

2. The apparatus according to claim 1 wherein said coating means comprises a substantially horizontal, rotatable coating roll partially submerged in the adhesive in said trough and adapted to contact the sheet material.

3. The apparatus according to claim 2 wherein said coating roll has a shaft which extends sealingly and rotatably through a wall of said trough, and terminates in a hand crank outside said housing.

4. The apparatus according to claim 3 wherein said coating means further comprises a rotatable feed roll for engaging and advancing the sheet material through said housing, said feed roll having a shaft which extends sealingly and rotatably through said wall of said trough and is drivingly connected to said coating roll shaft.

5. The apparatus according to claim 2 or 4 wherein said coating means further comprises stripping means for stripping the sheet material from said coating roll and guiding the sheet material upwardly out of said housing through said opening, said stripping means comprising a plurality of laterally spaced spring elements, each of said spring elements being fastened at its outer end to the top of said cover plate and extending into said housing through said opening with its inner end in resilient engagement with the upwardly facing surface of said coating roll, said flat cover being adapted to extend around and cover the outer ends of said spring elements.

6. The apparatus according to claim 2 or 4 wherein said coating means further comprises a substantially horizontal, elongated doctor element submerged in the adhesive in said trough and disposed parallel to and closely spaced from said coating roll, and doctor element positioning means for adjustably positioning said doctor element relative to said coating roll to control the thickness of the adhesive applied to said coating roll.

7. The apparatus according to claim 6 wherein said doctor element positioning means comprises a pair of elongated mounting slots supporting the ends of said doctor element, a pair of springs, each spring resiliently urging an end of said doctor element away from said coating roll, and a pair of pivoted stop levers, each of said stop levers having a lower end engaging an end of said doctor element to limit movement of said doctor element away from said coating roll, the position of said stop lever being set by a set screw extending through said cover plate and engaging the upper end of said stop lever.

* * * * *